US012780488B2

(12) United States Patent
Bonebrake et al.

(10) Patent No.: US 12,780,488 B2
(45) Date of Patent: Nov. 3, 2026

(54) COMPARTMENTALIZED CORRUGATED CRATE

(71) Applicants: Daniel Bonebrake, Keizer, OR (US); Mario Tolento, Salem, OR (US)

(72) Inventors: Daniel Bonebrake, Keizer, OR (US); Mario Tolento, Salem, OR (US)

( * ) Notice: Subject to any disclaimer, the term of this patent is extended or adjusted under 35 U.S.C. 154(b) by 274 days.

(21) Appl. No.: 18/739,189

(22) Filed: Jun. 10, 2024

(65) Prior Publication Data

US 2024/0425230 A1 Dec. 26, 2024

Related U.S. Application Data

(60) Provisional application No. 63/522,505, filed on Jun. 22, 2023.

(51) Int. Cl.
*B65D 5/49* (2006.01)
*B65D 5/32* (2006.01)

(52) U.S. Cl.
CPC ..... *B65D 5/48024* (2013.01); *B65D 5/32* (2013.01)

(58) Field of Classification Search
CPC ..... B65D 5/48024; B65D 5/32; B65D 5/68; B65D 5/3635; B65D 5/443; B65D 5/48048; B65D 5/441; B65D 5/445; B65D 5/48
USPC ..... 229/120.02, 120.36, 122.21, 122.3, 229/122.32, 199, 117.02, 120.03, 120.05, 229/120.24, 120.26, 120.34, 198.2; 206/386, 593, 594
See application file for complete search history.

(56) References Cited

U.S. PATENT DOCUMENTS

| | | | | |
|---|---|---|---|---|
| 2,151,472 A * | 3/1939 | Hubbard | B65D 5/248 | 229/117.17 |
| 2,404,067 A * | 7/1946 | Hill | B65D 5/68 | 229/122.34 |
| 5,505,371 A * | 4/1996 | O'Neill | B65D 5/48048 | 206/769 |
| 2010/0072105 A1* | 3/2010 | Glaser | B65D 5/5045 | 206/593 |
| 2014/0127475 A1* | 5/2014 | Bonebrake | B65D 81/1275 | 428/186 |

* cited by examiner

*Primary Examiner* — Christopher R Demeree

(57) ABSTRACT

The crate has a bottom base, two opposing side panels, two opposing interlocking end panels, a top cap, and at least one novel interlocking insert. The interlocking insert is constructed from at least one continuous corrugated sheet forming a compartment panel, insert fold, with corner flaps at each end. The bottom base has a length and width larger than the X-width and Y-length dimensions of the cargo to be shipped, the opposing side panels are coextensive to the Y-length of the cargo as fitting within the bottom base lip and a height matching the cargo's Z-height. The end panels have a center section in X-width and Z-height that matches dimensions of the interlocking insert's compartment panel. The end panel further has side interlocks and corner tabs, the side interlocks have a width matching the thickness of the side panel, and interlocking insert's corner tab.

4 Claims, 5 Drawing Sheets

Prior Art

COMPARTMENTALIZED CORRUGATED CRATE

FEDERALLY SPONSORED RESEARCH OR DEVELOPMENT

BACKGROUND

1. Field of the Invention

The invention relates to a shipping crate formed from laminated corrugated material, such as paper board, card board, or recycled fiber product, and in particular to a modular component crate system having multiple shipping compartments whose design provides customizable crate options that ships self-contained, easily assembles without tools, and is reusable as a system or in discrete parts, and when assembled having a stackable compression strength exceeding two hundred times the weight of the assembled crate.

2. Brief Description of the Prior Art

This disclosure describes generally a modular corrugate crating system, and specifically to innovative modular components thereof that overcome previous shortcomings in the prior art technology exampled in the crate system taught in U.S. Pat. No. 8,662,380 to Daniel Bonebrake. The prior art having modular components including a bottom base, two opposing side panels, two opposing interlocking end panels, and a top cap that fittingly assemble to form a corrugate crate. The side panels are secured within the bottom base by the crushing fit at the corners where the interlocking end panels press into the side panel ends. The top cap secures over the side and end panels to finish assembly of the crate making a single open space to enclose the cargo. The crate is constructed of corrugated and paper materials making the entire thing readily biodegradable.

The prior art corrugate crate design provides an environmentally sustainable alternative to wood and plastic crating, but there are use limitations:

- Small discrete components require the addition of custom cargo dividers often with foam inserts, thus increasing non-biodegradable waste, weight, and shipping expense without increasing structural integrity of the crate.
- Shipping heavy cargo causes the modular components to deform loosening fit at the corners, thus limiting crate component reuse to a single time.
- Forklifting elongated crates with heavy cargo causes bottom base flexing leading to structural failure of the crate, thus wooden or plastic substructures are needed to increase rigidity.
- Vertical stacking of loaded crates causes deformation at the corners resulting in toppling, thus prior art crate stacking is limited to two (2) crates high when loaded heavily.

There is an unfulfilled need for a more robust and durable corrugate crate system that can provide discrete cargo compartments, ship heavy cargo reusing components multiple times, withstand forklifting, and enable vertical stacking of three or more loaded crates.

SUMMARY OF INVENTION

To satisfy this unfulfilled need novel crate components are added to the interior of the prior art crating system. The novel componentry involves interlocking inserts that install within the corners of the crate structure to segment cargo space, strengthen corners, increase rigidity, thereby improving the usability and durability to include reuse of used prior art components. When assembled cooperatively with the prior art crating system use limitations are overcome. One skilled in the art will immediately realize the objects and advantages of the interlocking insert, to include:

- Simple corrugate sheet construction to enable easy manufacture and install into existing crating system;
- Customizable to segment discrete cargo compartments within crate interior;
- Increased crate rigidity enables forklifting without adding wood or plastic substructure;
- Eliminates the need for foam inserts or other nonbiodegradable cargo dividers;
- Tighter tolerance fit between end and side panels at the crate corners thereby providing greater vertical strength for higher stacking ability; and
- Reuse of used crate components even when deformed from previous stacking or shipping.

REFERENCE TABLE OF TERMS

Figure 1:
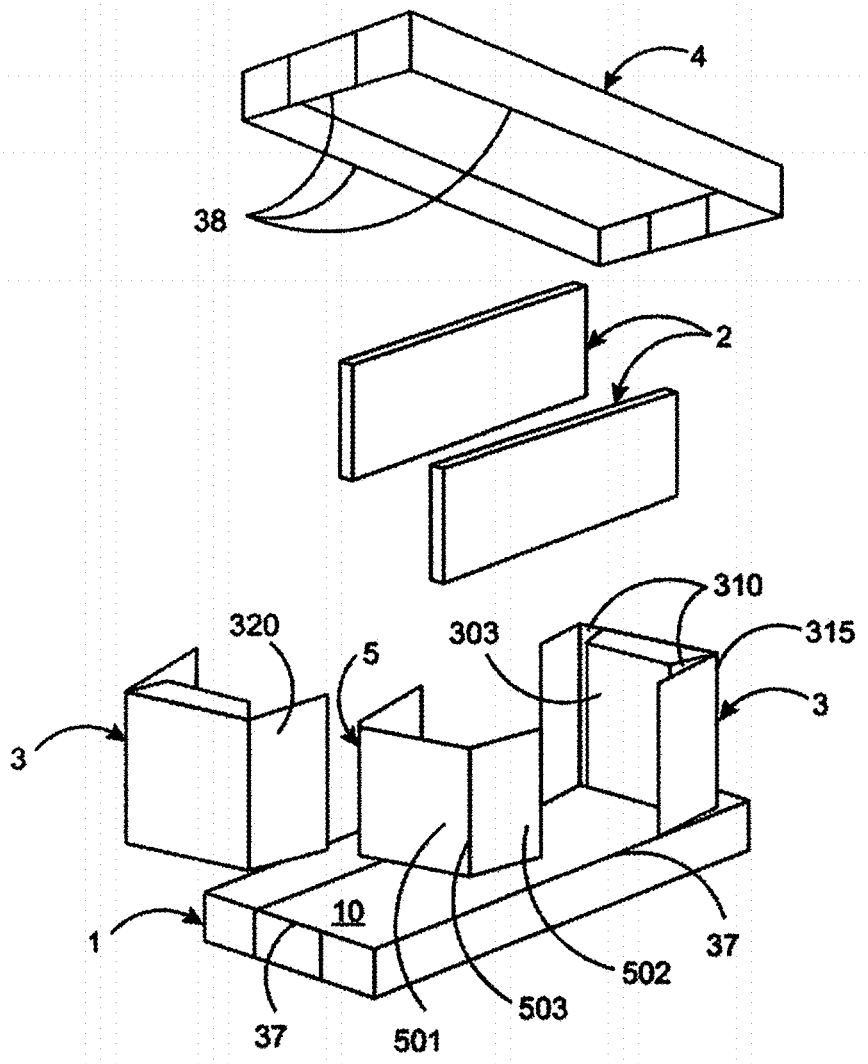
FIG. 1 is a perspective exploded view of a preferred embodiment with one interlocking insert.

Prior Art Bottom Base 1
Center base section 10
Bottom lip 37
Prior Art Top Cap 4
Upper lip 38
Prior Art End Panels 3
Center section 303
Side interlocks 310
corner fold 315
Corner tabs 320
Interlock width 330
Interior Center Section Thickness 331
Exterior Center Section Thickness 332
Prior Art Side Panels 2
End portion 205
Crushed side panel 206
Interlocking Insert 5
Compartment panel 501
Corner Flap 502
Insert Fold 503
End Fold 504
End Flap 505
Discrete Cargo Compartment 506

DETAILED DESCRIPTION OF DRAWINGS

Figure 2:
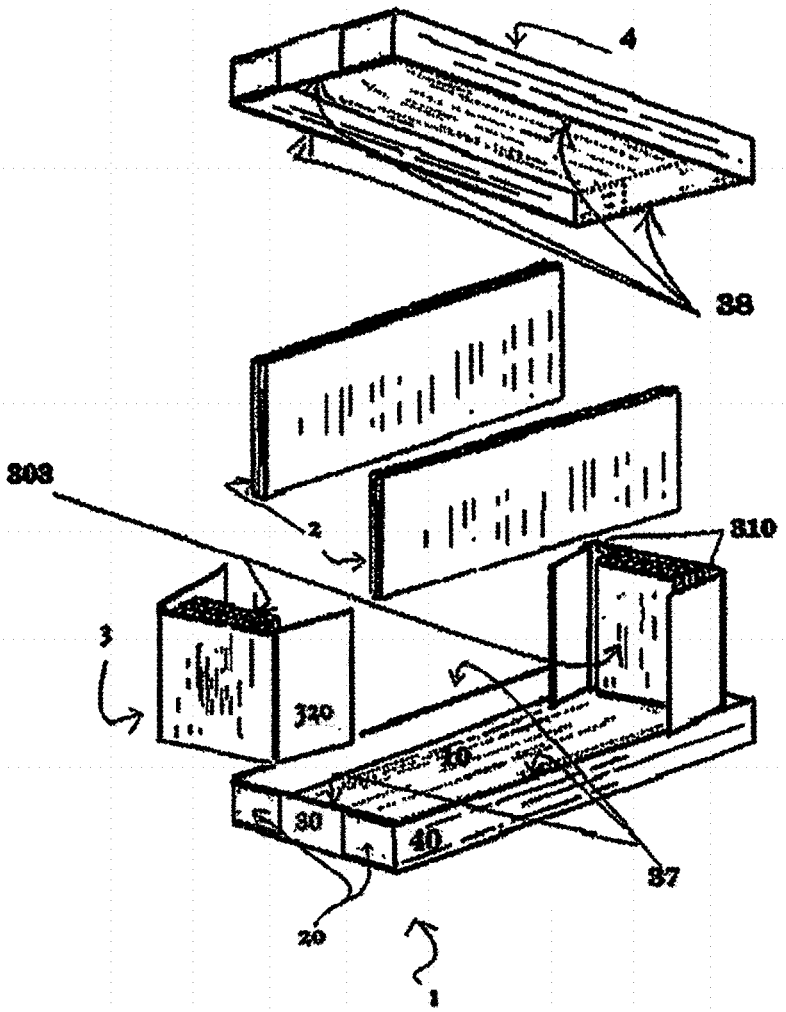
FIG. 2 is a perspective exploded view of the prior art crate system without interlocking insert.
Figure 3:
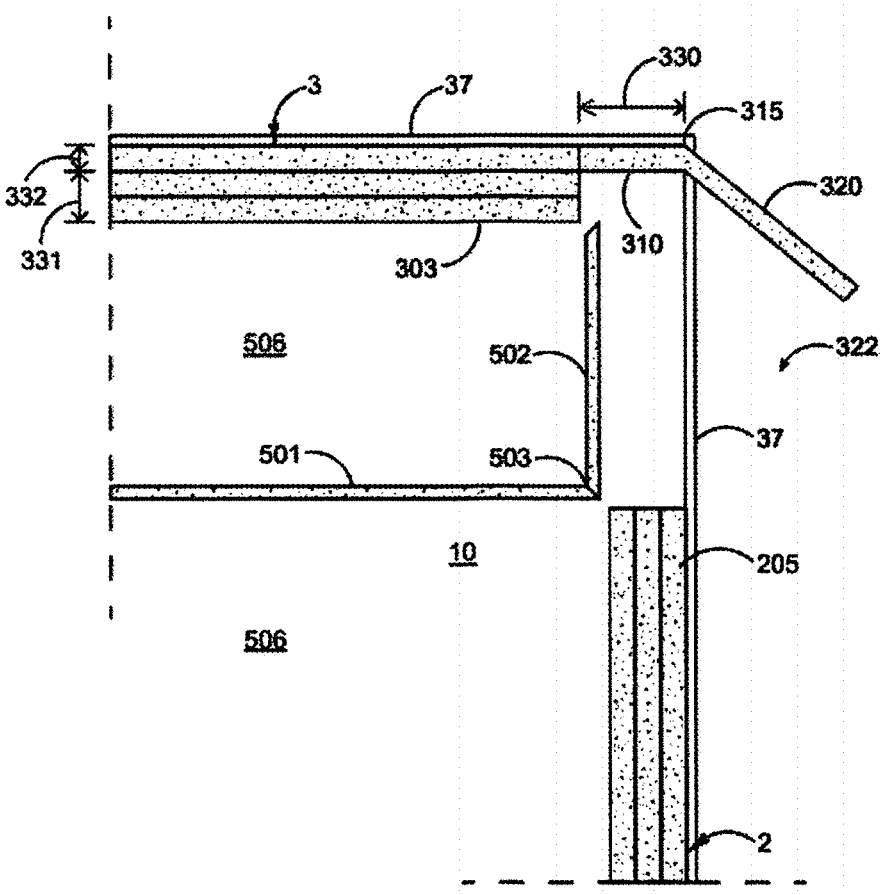
FIG. 3 is a top-down cutaway view of the corner assembly of the first preferred embodiment of the interlocking insert depicted in FIG. 1 with new crate components.

The preferred embodiment as depicted illustratively in FIG. 1 relates generally to improved corrugate crate components that specifically overcome the shortcomings of prior art crates by adding an interlocking insert 5, the interlocking insert 5 among other things being capable of segmenting internal cargo space. The interlocking insert 5 shown in FIG. 1 being constructed to fit within the prior art crate of FIG. 2, the prior art crate having six modular components including a bottom base 1, two side panels 2, two end panels 3, and a top cap 4 that when assembled provides a single cavity shipping crate. As shown in FIGS. 1 and 3, the interlocking insert 5 embodiment depicted has a compartment panel 501 with insert fold 503 on either side to form a corner flap 502 on either end, the interlocking insert 5 fits within the bottom base 1, the bottom base 1 having a bottom lip 37 that circumscribes the center base section 10 and holds together as described herein the interlocking insert 5, end panels 3, and side panels 2 compressively at each corner. A top cap 4 covers the interlocking insert 5, end panels 3 and side panels 2 as contained within the upper lip 38 perimeter, thereby defining a segmented interior with discrete cargo compartments 506 for the cargo to be placed and shipped as further embodiments depict in FIGS. 3, 4, and 5. The added structure provided by the interlocking insert 5 also increases corner crush strength, longitudinal crate rigidity, and increases stack ability of loaded crates to three or more.

Figure 5:
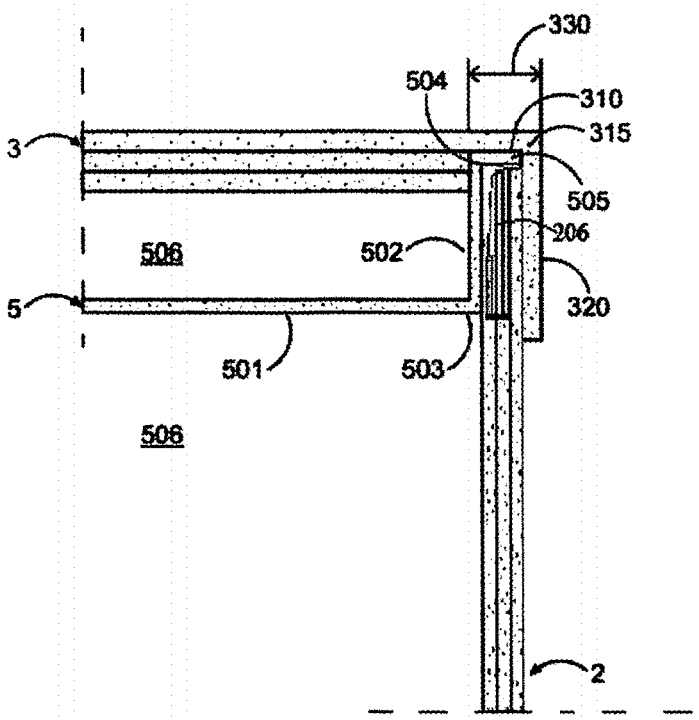
FIG. 5 is a top-down cutaway crate corner of the second embodiment shown in FIG. 4 illustrating corner components as assembled.

Shown illustratively in FIG. 3 by cutaway top corner view the circumscribing bottom lip 37 secures the distal end of a side panel 2 and end panel 3, and a portion of the corner flap 502 of the interlocking insert 5. In FIG. 3 the side panel 2 depicted as new without deformation at the end portion 205. The end panel 3 depicted as constructed from multiple continuous corrugated sheets forming corner tabs 320, corner folds 315, and side interlocks 310 at each end with a center section 303 in between each side interlock 310. The center section 303 is shown constructed from at least two corrugated sheets laminated together to provide an interior center section thickness 331 that is greater than the exterior center section thickness 332. The interlocking insert 5 being shown with the compartment panel 501 being constructed at width and height matching the end panel's 3 center section 303, and having corner flaps 502 being constructed longer than the interior center section thickness 331. The longer corner flaps 502 thereby locates the compartment panel 501 relative from the center section 303 such that a discrete cargo compartment 506 is formed. The preferred crate assembly includes positioning the interlocking insert 5 with each end panel 3 and side panel 2 together as located within the bottom lip 37 and resting on the center base section 10. The corner flap 502 is held parallel and adjacent with side panel 2 end portions 205 which are located together into the side interlocks 310 of the end panel 3 on top of the center base section 10 within the circumscribing bottom lip 37. The end portions 205 and corner flap 502 are pressed together with the side interlock 310 filling the interlock width 330 compressed by the swinging 322 of the corner tab 320 along the corner fold 315 axis compressing the end portion 205 and corner flap 502 firmly against the center section 303 where there is a slight crush of corrugated materials creating a tight fit. Once this is done as depicted in FIG. 5, the bottom lip 37 keeps the corner tabs 320 compressively in place thereby securing the components together within the center base section 10 thereby defining multiple discrete cargo cavities 506 for items to be placed and shipped. The top cap 4 shown in FIGS. 1 and 2 covers the interlocking inserts 5, end panels 3, and side panels 2 as contained within the upper lip 38 perimeter.

Figure 4:
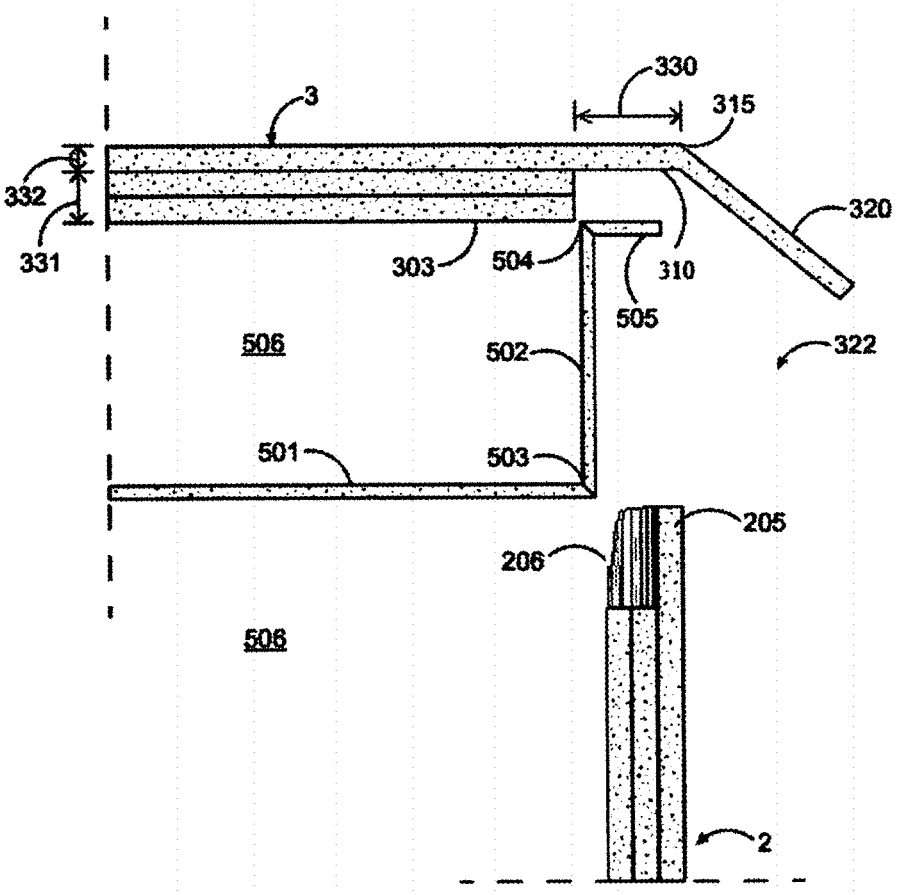
FIG. 4 is a top-down cutaway view of the corner assembly of a second preferred embodiment of the interlocking insert depicted with used crate components.

The preferred embodiment of the interlocking insert 5 (as shown in FIGS. 1 and 3) provides for a compartment panel 501 installed with new crate components. To demonstrate the robust design one alternative embodiment of the interlocking insert 5 is also shown in FIG. 4 and FIG. 5 with worn or damaged components. The alternative interlocking insert 5 embodiment depicted in FIG. 4 has the same compartment panel 501 with insert fold 503 on either side to form a corner flap 502, then additionally includes an end fold 504 to form an end flap 505 at either end. The end flap 505 has width less than the interlocking width 330 of the side interlocks 310. As shown in FIGS. 4 and 5 the side panel 2 has been previously used or damaged as illustratively depicted having crushed side panel 206 portion with fine gradient lines. The crushed side panel 206 is indicative of the wear and tear that the modular components suffer when used to ship heavy cargo resulting in the corners of the crate loosen in fit. As depicted in FIG. 5 one skilled in the art will recognize the advantage of installing the interlocking insert 5 as the added structure of the corner flap 502 and end flap 505 fills the space from damaged areas to tighten the fit of used side panels 2 components, thereby enabling additional reuses and increasing strength.

To install the interlocking insert 5 shown in FIG. 4 corner flaps 502 are held parallel with each side panel 2 with end flaps 505 located between the distal end of the side panel 2 end portions 205 and the side interlocks 310. The corner flap 502 held parallel to the side panel 2 against the center section 303 with the end portions 205 and end flaps 505 pressed together abutting the side interlocks 310 filling the interlock width 330, then compressively secured with the folding over 322 about the corner fold 315 axis of each corner tab 320 sandwiching the corner flap 502, end portions 205 and end flaps 505 between the corner tab 320 and center section 303 where there is a slight crush of corrugated materials creating a tight fit as depicted in FIG. 5. Once this is done, the bottom lip 37 (depicted in FIGS. 1 and 3) keeps the corner tab 320 compressively in place thereby securing the components together keeping them from moving. As depicted in FIGS. 1 and 2 the top cap 4 covers the interlocking insert 5, end panels 3, and side panels 2 as contained within the upper lip 38 perimeter, thereby defining within discrete cargo compartment 506 for the cargo to be placed and shipped.

The described and shown embodiments, while illustrative of the invention, do not limit the present invention to the various embodiments described herein, but includes all embodiments having equivalent elements, modifications, omissions, combinations, adaptations and/or alterations as would be appreciated by those skilled in the art. The manner of compressively securing the interlocking insert's 5 corner flaps 502 using the corner fold 315 as a hinge may be varied, and other modifications will occur without departing from the true scope of invention as defined and described in the claims. The claims are to be interpreted broadly based on the language employed in the claims as defined by the specification, and not limited by the disclosure of specific embodiments, configuration, or illustrations herein.

Having thus described the invention, what is claimed as new and desired to be secured by Letters Patent is as follows:

1. A modular corrugated reusable compartmentalized crate having a bottom base, two opposing side panels, two opposing interlocking end panels, at least one interlocking insert, and a top cap that when assembled defines multiple cavities for receiving cargo placed therein, comprising:

said bottom base having a center base section, end tabs, side tabs, and corner tabs all constructed from at least one sheet of corrugated material having the end tabs and side tabs folded up forming a bottom lip;

said top cap being of substantially the same construction as the bottom base but having a top lip constructed and arranged to fit over said bottom lip;

said side panels constructed of at least two corrugated side sheets laminated together, each said side panel having opposite side-panel end portions;

said end panels constructed from at least one continuous corrugated sheet forming a corner tab, corner fold, and side interlock at each end with a center section in between said side interlocks, said center section being constructed from at least two corrugated sheets laminated together having an interior center section thickness that is greater than an exterior center section thickness;

said interlocking insert constructed from at least one continuous corrugated sheet forming a compartment panel matching size with said center section, the compartment panel with insert folds and corner flaps at each end, said corner flaps having length exceeding an interior center section width;

such that when the crate is assembled, said corner flaps are parallel with said side panel end portions and abut the side interlocks and are compressively secured by the corner tabs swinging about respective corner fold axes to compress the corner flaps and side panel end portions between the corner tabs and the center section, slightly crushing the corrugated sheet material therebetween, all held secure by the bottom lip and top lip.

2. The apparatus of claim 1, wherein at least one interlocking insert forms a compartment panel with insert folds and corner flaps with an end fold to form an end flap on either end, said end flaps have length less than the side interlock width thereby when the crate is assembled, said corner flaps are parallel with said side panels that abut the side interlocks thereby locating said end flaps within the interlock width parallel with said end panel; such that when the corner tabs swing about the respective corner fold axes said corner flap, end flap, and side panel end portions compress between the corner tab and the center section, slightly crushing the corrugated sheet material therebetween, all held secure by the bottom lip and top lip.

3. The apparatus of claim 2, wherein each corner flap is captured within a respective side interlock together with a respective side-panel end portion before the respective corner tab is folded over.

4. The apparatus of claim 2, wherein the compartment panel extends from one end panel to the opposing end panel, therein increasing the longitudinal rigidity of the crate.

* * * * *